US006146011A

United States Patent [19]

Ōwai

[11] Patent Number: 6,146,011

[45] Date of Patent: Nov. 14, 2000

[54] SELF-CORRECTING WATCH

[75] Inventor: Tōru Ōwai, Tokyo, Japan

[73] Assignee: NEC Corporation, Japan

[21] Appl. No.: 08/984,587

[22] Filed: Dec. 3, 1997

[30] Foreign Application Priority Data

Dec. 3, 1996 [JP] Japan ..... 8-322829

[51] Int. Cl.[7] ..... G04B 17/20

[52] U.S. Cl. ..... 368/202; 368/187

[58] Field of Search ..... 368/180, 200–202

[56] References Cited

U.S. PATENT DOCUMENTS

| | | | |
|---|---|---|---|
| 4,068,463 | 1/1978 | Maeda et al. | 368/187 |
| 4,730,286 | 3/1988 | Aizawa et al. | 368/202 |
| 5,717,661 | 2/1998 | Poulson | 368/202 |

FOREIGN PATENT DOCUMENTS

| | | |
|---|---|---|
| 56-11384 | 2/1981 | Japan . |
| 59-9732 | 1/1984 | Japan . |
| 2-170088 | 6/1990 | Japan . |
| 5-341065 | 12/1993 | Japan . |
| 6-214059 | 8/1994 | Japan . |

*Primary Examiner*—Bernard Roskoski

*Attorney, Agent, or Firm*—Ostrolenk, Faber, Gerb & Soffen, LLP

[57] ABSTRACT

To provide a self-correcting watch wherein a high precision self-correction of the watch circuit can be realized without any troublesome operation, a self-correcting watch of the invention having a zero second set button comprises: a time interval counter circuit for counting a time interval from a first pressing of the zero second set button for time setting until each following pressing of the zero second set button for manually correcting time indication; a correction value memory for storing correction information including the time interval and an accumulation of correction values of the time indication performed both manually and automatically from the first pressing of the zero second set button; and a correction value calculator circuit for calculating an absolute time interval at which the time indication is to be corrected automatically by one second, from the time interval of a concerning pressing of the zero second set button counted by the time interval counter, a correction value of the time indication manually corrected by the concerning pressing of the zero second set button and the correction information stored in the correction value memory at a previous pressing of the zero second set button.

5 Claims, 3 Drawing Sheets

SELF-CORRECTING WATCH

BACKGROUND OF THE INVENTION

The present invention relates to a self-correcting watch, and more particularly to an electronic watch having a circuit for correcting its time indication automatically.

FIG. 3 is a block diagram illustrating a self-correcting watch of the prior art (hereafter called the first prior art) disclosed in a Japanese patent application laid open as a Provisional Publication No. 170088/'90.

In the prior art of FIG. 3, a forward signal 47*a* or a late signal 47*b* having a certain pulse width according to a correction value, +3 sec or −5 sec, for example, is impressed to a polarity register 40, by manipulating a correction switch 31. The polarity register 40 registers a signal polarity, that is, forward or late.

The correction value Δt is counted by a Δt counter 35. On the other hand, at the rising edge of the forward/late signal 47*a*/*b*, a count value indicating a time passage T of a T1 counter 32, which is counting hour pulses from a preceding correction, is registered in a T register 34, and at the falling edge of the forward/late signal 47*a*/*b*, the T1 counter 32 is reset for counting hour pulses until a next correction.

The time passage T is divided by the correction value Δt by a divider 36 and registered in a T/Δt register 37 as a correction interval T/Δt.

A comparator 38 generates a correction signal 46 each time a count value of a T2 counter 33, which is also counting the hour pulses and reset by the correction signal 46, attains the correction interval T/Δt. With the correction signal 46, the correction circuit 39 suppresses or adds a one second pulse referring to the polarity registered in the polarity register 40.

Thus, the lead or lag of time indication is corrected automatically in the prior art of FIG. 3.

In another Japanese patent application laid open as a Provisional Publication No. 9732/'84 (hereafter called the second prior art), a self-correcting timer provided in a computer and backed up with a battery is disclosed, wherein timer correction data registered in a non-volatile memory is revised every time a user corrects the timer indication through its key board. The self-correcting timer self-corrects the timer indication at a certain interval referring to the timer correction data.

In still another Japanese patent application laid open as a Provisional Publication No. 11384/'81 (hereafter called the third prior art), there is disclosed a computer equipped with a timer, wherein a correction value and a correction interval in a battery backed up RAM are set by a customer engineer, for example, together with last correction date. When the computer is raised up, the computer refers the last correction date, and if more than the correction interval is passed from the last correction date, the computer corrects the timer with the correction value, revising the last correction date by adding the correction interval thereto.

However, in the self-correction watch of the first prior art, there is a problem that the correction interval T/Δt is written over the previous correction interval, and so the user should manipulate the correction switch 31 considering the previous correction value for correcting the watch correctly after a second correction.

In the second prior art, the timer correction should be entered through the key board, and an appropriate correction value should be prepared in the third prior art, because, otherwise, incorrect correction is left repeated. These are also problems which are present in the prior art.

SUMMARY OF THE INVENTION

Therefore, an object of the present invention is to provide a self-correcting watch wherein a high precision self-correction of the watch circuit can be realized, even without a high-precision and high-cost crystal oscillator, without any troublesome operation.

In order to achieve the object, a self-correcting watch of the invention having a zero second set button comprises:

a time interval counter circuit for counting a time interval from a first pressing of the zero second set button for time setting of the self-correcting watch until each following pressing of the zero second set button for manually correcting time indication of the self-correcting watch;

a correction value memory for storing correction information at said each following pressing of the zero second set button, the correction information including the time interval and an accumulation of correction values of the time indication performed both manually and automatically from the first pressing of the zero second set button;

a correction value calculator circuit for calculating an absolute time interval at which the time indication is to be corrected automatically by one second, from the time interval of a concerning pressing of the zero second set button counted by the time interval counter, a correction value of the time indication manually corrected by the concerning pressing of the zero second set button and the correction information stored in the correction value memory at a previous pressing of the zero second set button; and a correction actuator circuit for automatically correcting the time indication by one second at every interval indicated by the absolute time interval.

Therefore, a high precision self-correction of the watch circuit can be realized in the self-correcting watch of the invention, by simply pressing the zero second set button provided therein.

BRIEF DESCRIPTION OF THE DRAWINGS

The foregoing, further objects, features, and advantages of this invention will become apparent from a consideration of the following description, the appended claims, and the accompanying drawings wherein the same numerals indicate the same or the corresponding parts.

In the drawings.

DETAILED DESCRIPTION OF THE PREFERRED EMBODIMENTS

Now, embodiments of the present invention will be described in connection with the drawings.

Figure 1:
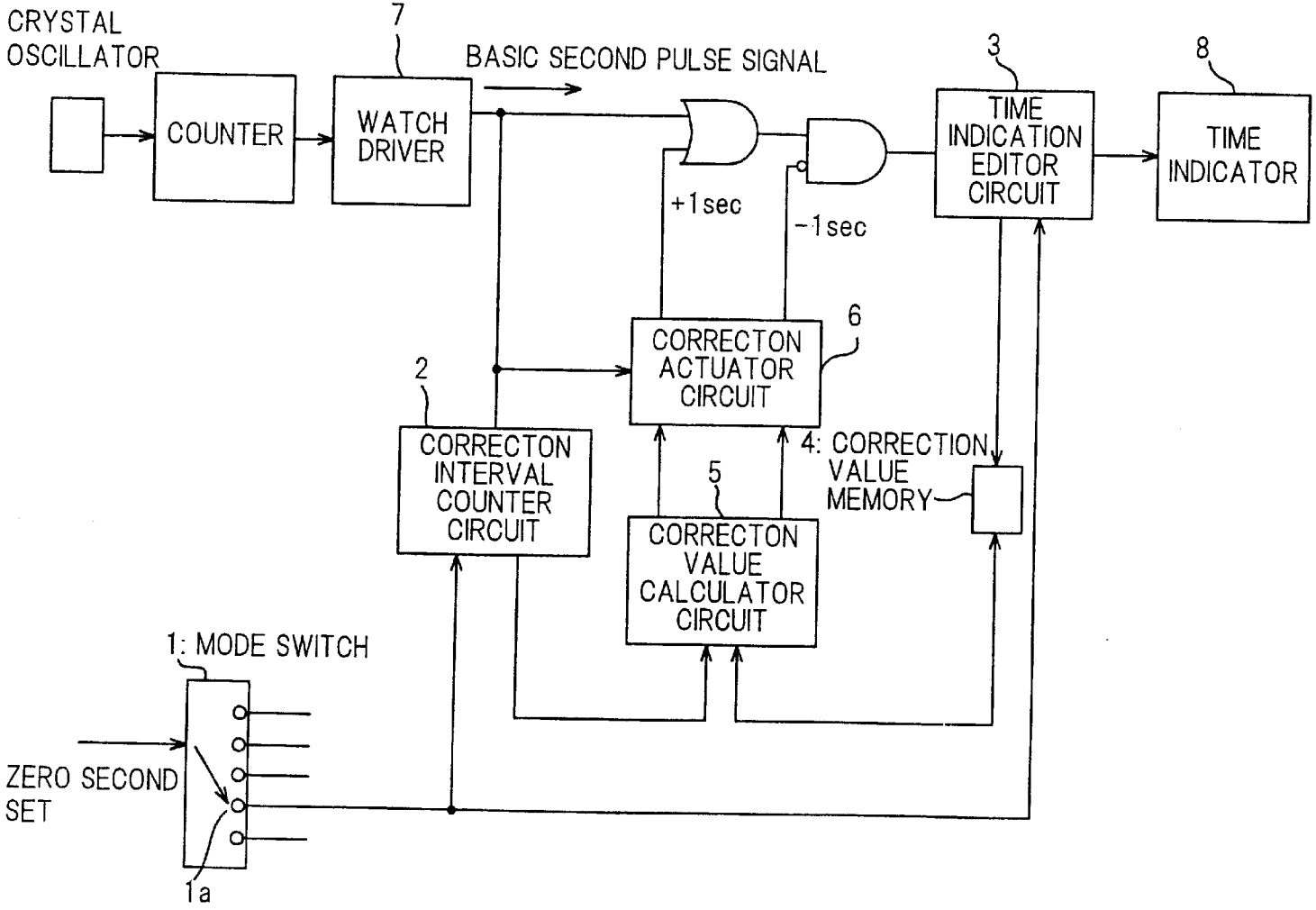
FIG. 1 is a block diagram illustrating a self-correcting watch according to an embodiment of the invention.

FIG. 1 is a block diagram illustrating a self-correcting watch according to an embodiment of the invention.

Referring to FIG. 1, the self-correcting watch comprises a mode switch 1, a correction interval counter circuit 2, a time indication editor 3, a correction value memory 4, a correction interval calculator circuit 5, a correction actuator circuit 6, a watch driver 7 having a crystal oscillator and a counter, and a time indicator 8.

The mode switch 1 is a manipulator of the watch circuit talking charge of selecting one of various operational modes of the watch circuit, such as setting a time, starting the operation and so on. By pressing a zero second set button 1*a* included in the mode switch 1 in synchronization with a broadcast time signal, for example, the watch circuit starts from zero second of the set time or nearest minute of actual time indication. That is, when the actual time indication is more than −30 seconds to a minute and less than +30 seconds from the minute, the time indication is restarted from just the minute by pressing the zero second set button 1*a*.

Counting a time interval from a first pressing of the zero second set button 1*a* for starting the watch circuit, the correction interval counter circuit 2 reports the time interval to the correction value calculator circuit 5, each time when a manual correction of the watch circuit is performed afterwards.

The time indication editor circuit 3 revises the time indication to be displayed on the time indicator 8 according to the pressing of the zero second set button 1*a*, and delivers a correction value to the correction value memory 4.

The correction value memory 4 stores the correction value delivered from the time indication editor circuit 3 and sends the correction value to the correction value calculator circuit 5. The correction value memory 4 also stores the time interval delivered from the correction interval counter circuit 2.

The correction value calculator circuit 5 calculates an absolute time interval at which the time indication should be corrected by ±1 second.

According to the absolute time interval for the ±1 second correction, the correction actuator circuit 6 inserts one pulse into or omits one pulse from a basic second pulse signal output from the watch driver 7 to be supplied to the time indication editor circuit 3 for correcting the time indication to be displayed on the time indicator 8.

Figure 2:
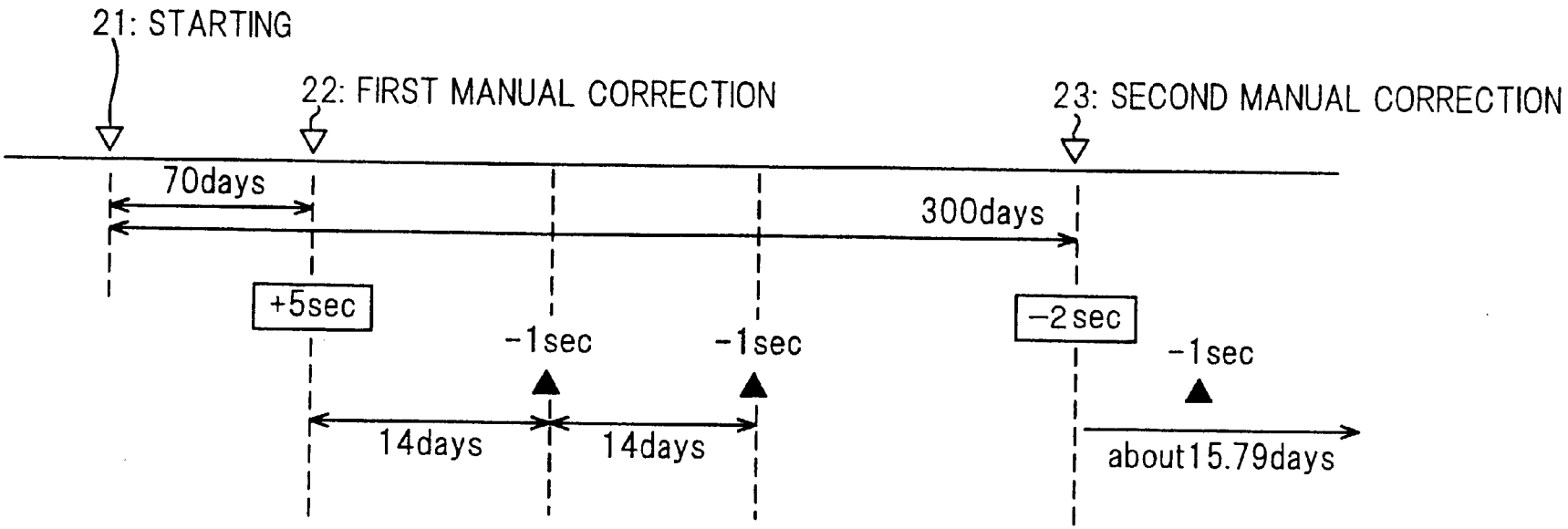
FIG. 2 is a timing chart illustrating operation of the self-correcting watch of FIG. 1.
Figure 3:
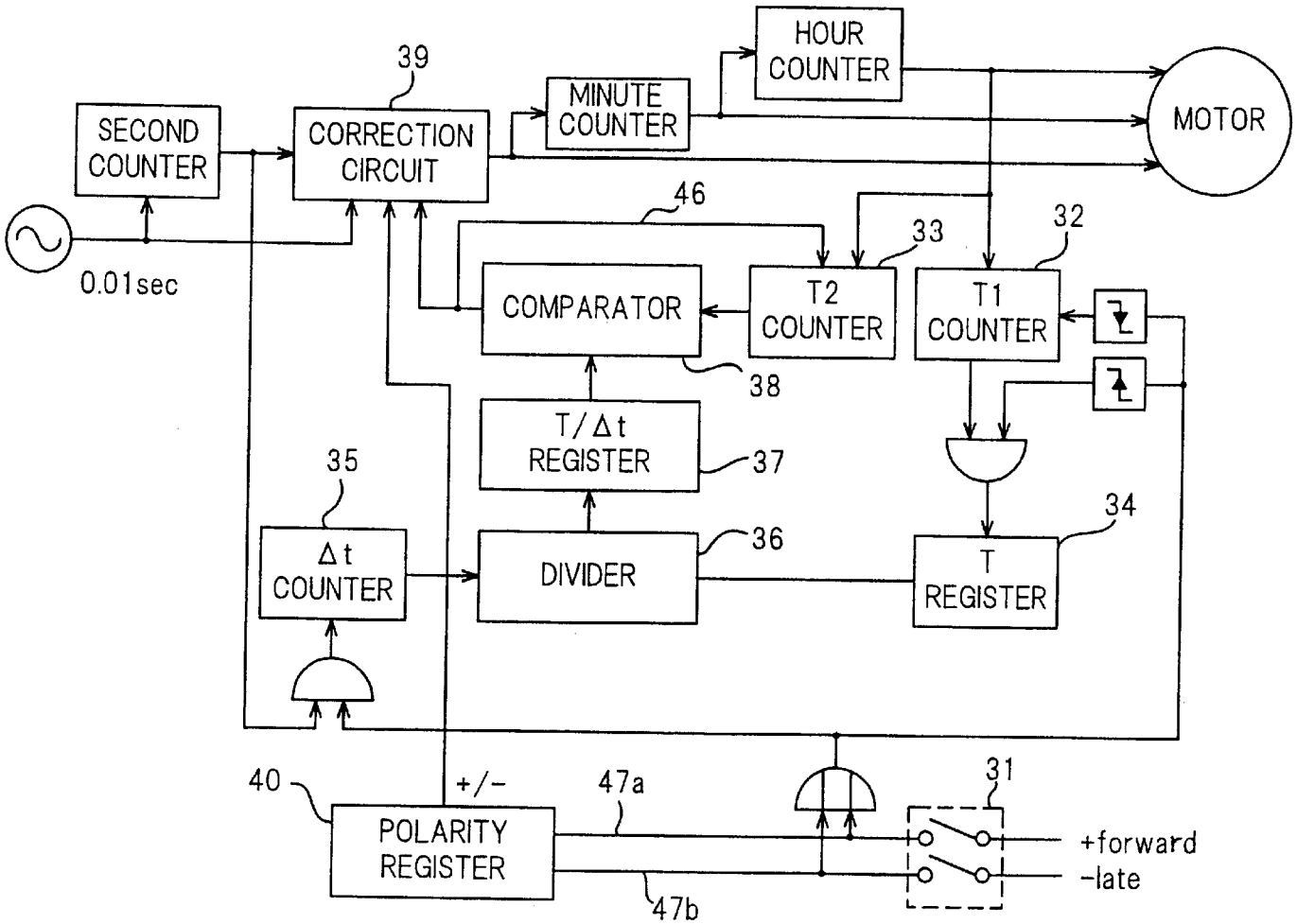
FIG.3 PRIOR ART
FIG. 3 is a block diagram illustrating a self-correcting watch of a prior art.

Now, operation of the self-correcting watch of FIG. 1 is described referring to a timing chart of FIG. 2. An example is shown wherein an owner begins to use the self-correcting watch of FIG. 1 at a starting 21, performs a first manual correction 22 after 70 days of the starting 21 and a second manual correction 23 after 300 days of the starting 21.

At the starting 21, the owner sets a time and presses the zero second set button 1*a*, in synchronization with a TV time signal, for example. Then, the watch circuit starts and the correction interval counter circuit 2 begins to count the basic second pulse signal.

At the first manual correction 22 after 70 days, the owner presses the zero second set button 1*a* (for correcting +5 seconds' lead, for example), the time indication editor circuit 3 corrects its second indication to zero and a correction value, +5 seconds in the example, is stored in the correction value memory 4.

The correction interval counter circuit 2 delivers the correction interval 70 days from the starting 21 to the correction value calculator circuit 5 and the correction value memory 4, wherein correction information "70 days, +5 seconds" is registered.

The correction value calculator circuit 5 calculates and sends the absolute time interval to the correction actuator circuit 6 as follows, in the example:

$$\text{Absolute time interval}=70\text{ days}/+5\text{ sec}$$

$$=70\times24\times60\times60/+5=1{,}209{,}600\text{ (sec)}.$$

Thus, the correction actuator circuit 6 is set to perform self-correction at an absolute time interval of 1,209,600 sec.

The correction actuator circuit 6 begins to omit one pulse every 1,209,600 sec=14 days from the basic second pulse signal to be supplied to the time indication editor circuit 3 for self-correcting the time indication, and hence correct time indication continues to be displayed for a long time.

When, after 300 days from the starting 21, two seconds' lag is found, for example, and the owner performs the second manual correction 23 of FIG. 2 by pressing the zero second set button 1*a* in synchronization with a time signal, the time indication editor circuit 3 revises the time indication in the same way as in the first manual correction 22.

The correction value calculator circuit 5 revises the absolute time interval to be referred to by the correction actuator circuit 6, by calculating a new absolute time from the concerning correction value, −2 sec in the case, the concerning correction interval, 300 days, and further the correction information "70 days, +5 seconds" registered in the correction value memory 4, as follows.

$$\text{Absolute time interval}=300\text{ days}/\text{total correction}$$

$$=300\text{ days}/\{300/(70/+5)+(-2)\}\text{ sec}$$

$$=300\times24\times60\times60/+19=1{,}364{,}210\text{ (sec)}.$$

Therefore, the correction actuator circuit begins to omit one pulse every 1,364,210 sec=about 15.79 days, and the correction information in the correction value memory 4 is revised into "300 days,+19 sec".

Hence, still more correct time indication continues to be displayed after the second manual correction 23.

Heretofore, the embodiment is described in connection with the example having an inclination to advance. However, it goes without saying that the watch circuit having an inclination to delay can be self-corrected by adding one pulse at every absolute time interval in a similar way to the basic second pulse signal instead of omitting one pulse.

Thus, a high precision self-correction of the watch circuit can be realized in the self-correcting watch of the invention, even without a high-precision and high-cost crystal oscillator, without any trouble-some operation by simply pressing the zero second set button provided therein.

What is claimed is:

1. A self-correcting watch having a set button, said self-correcting watch comprising:

a time interval counter which counts a time interval from a first pressing of said set button until each following pressing of said set button, each pressing of said set button being a manually corrected time indication for the self-correcting watch;

a correction value memory which stores correction information at each pressing of said set button;

a correction value processor which calculates an absolute time interval at which said time indication is to be corrected automatically, said absolute time interval being calculated from said time interval of a particular pressing of said set button counted by said time interval counter, a correction value of said time indication manually corrected by said particular pressing of said set button, and said absolute time interval further being calculated from said correction information stored in said correction value memory from a previous pressing of said set button; and a correction actuator which corrects said time indication at every interval indicated by said absolute time interval.

2. The self-correcting watch as claimed in claim 1, wherein said correction information includes said time interval and an accumulation of correction values of said time indication performed both manually and automatically from said first pressing of said set button.

3. The self-correcting watch as claimed in claim 1 wherein said set button is a zero second set button.

4. The self-correcting watch as claimed in claim 1, wherein said correction actuator automatically corrects said time indication by one second at every interval indicated by said absolute time interval.

5. A method of correcting a time indication on a watch having a set button, said method comprising:

counting a time interval between a first pressing of said set button until each following pressing of said set button;

storing stored correction information at each pressing of said set button;

calculating an absolute time interval at which said time indication is to be corrected, said absolute time interval being calculated from said time interval of a particular pressing of said set button, a correction value of said time indication which is created by said particular pressing of said set button, and said stored correction information which relates to a previous pressing of said set button; and correcting said time indication based upon said absolute time interval.

* * * * *